United States Patent [19]

DiGuiseppi et al.

[11] Patent Number: 5,074,505

[45] Date of Patent: Dec. 24, 1991

[54] SUPPORT ATTACHMENT FOR HOLDING BOTTLES WITHIN A BOTTLE BLOCK

[75] Inventors: James L. DiGuiseppi, Durham, N.C.; Lanny V. Grade, Oklahoma City, Okla.

[73] Assignee: Akzo N.V., Arnhem, Netherlands

[21] Appl. No.: 531,472

[22] Filed: Jun. 1, 1990

[51] Int. Cl.[5] ..... B01L 9/06

[52] U.S. Cl. ..... 248/311.2; 248/316.3; 248/316.7

[58] Field of Search ..... 248/311.2, 316.7, 231.8, 248/316.3

[56] References Cited

U.S. PATENT DOCUMENTS

| | | | |
|---|---|---|---|
| 1,448,338 | 3/1923 | Drew | 248/311.2 X |
| 3,709,429 | 1/1973 | McKenzie et al. . | |
| 3,918,920 | 11/1975 | Barber . | |
| 4,040,533 | 8/1977 | De Boer et al. . | |

FOREIGN PATENT DOCUMENTS

| | | |
|---|---|---|
| 365828 | 9/1989 | European Pat. Off. . |
| 2750896 | 11/1976 | Fed. Rep. of Germany . |
| DS2212222 | 7/1975 | France . |
| 2254243 | 8/1975 | France . |

*Primary Examiner*—Alvin C. Chin-Shue
*Attorney, Agent, or Firm*—Spencer & Frank

[57] ABSTRACT

A support attachment for use with a holding unit having at least two adjacent cavities with longitudinally axes provides sufficient pressure to squarely hold and stabilize bottles within the cavities. The support attachment has a central axis and includes a plate adapted to be fitted to the holding unit and a pair of elongated legs in symmetrically spaced relationship with respect to the central axis for supporting bottles held in two adjacent cavities in the holding unit. Each leg extends, in the same direction, from opposite ends of the plate and has first and second ends. The first ends are joined at substantially right angles to the plate and the second ends are normally biased toward one another so that when the plate is fitted onto the holding unit, one of the legs extends longitudinally into one of the adjacent cavities while the other leg extends into another adjacent cavity.

7 Claims, 4 Drawing Sheets

SUPPORT ATTACHMENT FOR HOLDING BOTTLES WITHIN A BOTTLE BLOCK

BACKGROUND OF THE INVENTION

The present invention relates to a support attachment for use with a holding unit having two adjacent cavities for holding bottles and a method of using the support attachment. More particularly, the present invention relates to a durable support attachment that allows for manufacturing variabilities and firmly holds a wider number of manufactured bottles while the holding unit is moving.

Typically, in diagnostic investigation of a plurality of fluid samples, racks or bottle blocks are used to carry and hold several containers or bottles of samples. This is done not only for ease of movement of a plurality of containers as a single unit, but also for a transfer vehicle to carry the sample containing bottles through a diagnostic or analytic instrument.

These bottle holding units usually are rectangular in shape and have one or more cavities defining chambers in which bottles or containers of media, such as blood samples are carried. Glass containers or bottles are conventionally used for holding such samples.

Because the manufacturing tolerances of the glass bottles are larger than the tolerances allowed between an inserted bottle and the chamber, the chambers are manufactured with a built-in wiggle problem. Resilient packing material has been used so that the entire range of manufactured containers fit snugly within the chambers. For example, the interior of the chambers are lined with packing material, such as felt which resiliently presses against the side walls of a container inserted within the chamber. Such a device is described in copending U.S. patent application Ser. No. 07/351,476.

However, the use of resilient packing material, as described above, provides less than optimum support for bottles placed in a chamber. First, the initially obtained snug fit is not long lasting as the packing material itself, quickly wears away becoming thinner due to the inserting and removal of bottles. Further, the adhesive used to secure strips of the packing material to the interior of the chambers looses its stickiness and as a result, the packing material strips are pushed into the bottom well of the chambers. Since the bottles must remain still within the chambers to obtain accurate diagnostic or analytic readings of the samples, other materials and techniques have been tried to overcome these problems.

Instead of lining the interior of chambers, circular washers were installed on the top surface of each chamber of the bottle holding unit. The installed washers slightly overlapped the circumference of each chamber. Thus, bottles are first inserted into the narrower opening of the washer. The bottles are held within the chamber by the washer which hugs the sides or shoulders of the bottles. These washers were made from soft rubber first and then hard rubber, but the support obtained was less than satisfactory.

Soft rubber washers are resilient and easily receive various sizes of bottles. But the soft rubber wears away too fast and thus, loses its ability to hold a wide range of manufactured bottles firmly in place. The hard rubber washers are dependent on the specific size of the bottles and thus, only securely hold a portion of the number of manufactured bottles. While washers made from hard rubber retained their shape longer than the soft rubber, the elasticity of the hard rubber limits the number of bottles which the washer satisfactorily holds.

A heater block which holds a plurality of test tubes is described in U.S. Pat. No. 4,256,697 to Baldwin. Baldwin's heater block has a plurality of sockets or chambers, each of which is filled with suitable liquid having good heat transfer properties. The upper end of each chamber is enclosed by a resilient, flexible and elastic finger-like sleeve which can protrude downwardly into the chamber to be immersed in the liquid. Test tubes are inserted into the chambers through the sleeves which may be formed from any of a variety of suitably flexible, resilient and elastic materials such as an appropriate latex, plastic or silicone rubber material.

Applicants determined that the use of packing material or a strip of felt on the interior of each chamber within the block, as well as employing rubber washers or sleeves were less than optimum. According to Applicants' laboratory tests, bottles which were pulled out of and reinserted within chambers employing packing material or soft rubber needed to be replaced too often. Hard rubber washers gauged or ripped the identification labels of larger bottles thereby impeding the identification of the sample being tested and did not securely hold small bottles.

SUMMARY OF THE INVENTION

It is an object of the present invention to provide an attachment to a holding unit which securely holds bottles within cavities of the holding unit and thus, prevents the bottles from moving within or falling out of the cavities during movement of the holding unit.

More particularly stated, it is an object of the present invention to provide a support attachment which retains it shape and exerts sufficient pressure on the bottles thereby holding the bottles squarely within the cavity or chamber.

It is an associated object to provide a support attachment that enables bottles to be smoothly inserted in the chambers so that paper labels identifying the contents of the bottle are not gouged or ripped while the bottle is being pulled out or inserted within the chamber.

A further object of the invention is to provide an attachment suitable for a variety of bottles manufactured within a tolerance range and which is long lasting and thus, cuts down on the costs of replacing these devices.

A related object is to provide a method of using the support attachment of the instant invention.

These and other objects of the present invention are accomplished by providing a support attachment for use with a holding unit having at least two adjacent cavities with longitudinal axes for holding bottles. The support attachment, according to the invention has a central axis and comprises a plate adapted to be fitted onto the holding unit and a pair of elongated leg means in symmetrical spaced relationship with respect to the central axis for supporting bottles held in adjacent cavities of the holding unit. Each leg means of the pair of elongated leg means has first and second ends and extends, in the same direction, from opposite ends of the plate. The first ends of each leg means are joined at substantially right angles to the plate and the second ends of each leg means are normally biased towards one another. The plate includes means for fastening the support attachment to a holding unit and when the plate is fitted onto the holding unit, one of the leg means extends longitudinally into one cavity while the other leg means extends into an adjacent cavity.

A method of using the support attachment according to the invention is described below.

First, a holding unit having at least two adjacent cavities formed therein is provided. The cavities of the holding unit are separated by a wall having predetermined spacing. The support attachment according to the invention is inserted into the two adjacent cavities such that one of the pair of leg means longitudinally extends into one cavity while the other of the pair of leg means longitudinally extends into the other adjacent cavity. The plate of the support attachment is fitted onto the holding unit at the predetermined spacing between the two adjacent cavities. A bottle of media having an identification label is inserted into a cavity so that the bottle rests against the leg means inserted therein and the leg means exerts sufficient pressure to keep the bottle from moving within the cavity.

BRIEF DESCRIPTION OF THE DRAWINGS

The foregoing and other objects and advantages of the invention will be appreciated more fully from the following description thereof, with reference to the accompanying drawings wherein.

DESCRIPTION OF THE PREFERRED EMBODIMENTS

Figure 1:
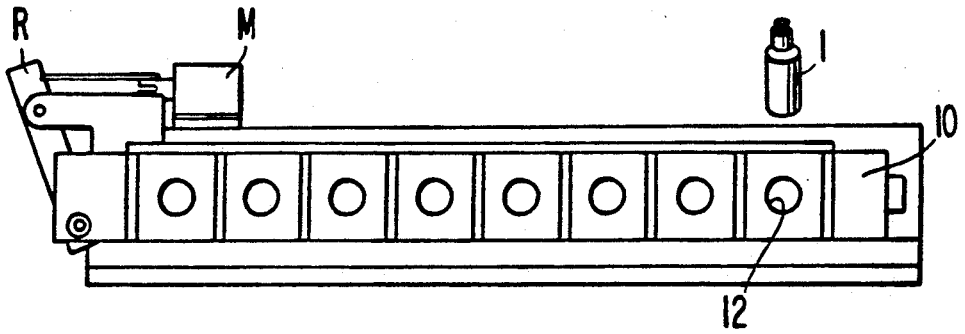
FIG. 1 is a prospective view of an apparatus with which the instant invention can be used.

Turning first to FIG. 1 of the drawings, there is shown a holding unit 10 having eight (8) cylindrical slots or chambers 12 to accommodate sample bottles 1. Sample bottles 1 can be tall, slender cylindrical containers which hold samples of medium to be analyzed while being held within a chamber 12 of holding unit 10.

Holding unit 10 is constructed and arranged in such a manner so that bottles held within it chambers 12 can be shaken back and forth by rocking motor M and rocking mechanism R attached to motor M and holding unit 10. The rocking motion is necessary to keep mixtures properly agitated and stirred within the bottles 1 to promote proper microbial growth.

Figure 2:
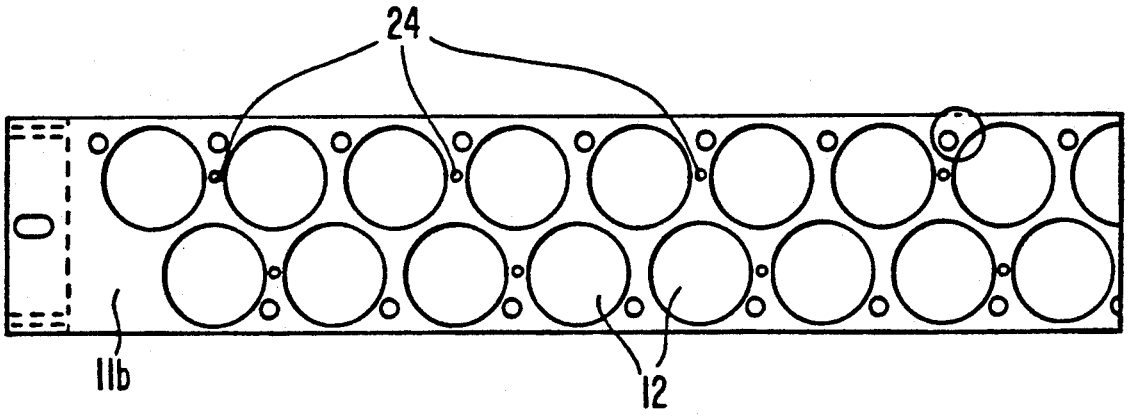
FIG. 2*a* is an exploded view of a modified holding unit according to the instant invention.
FIG. 2*b* is a front view of the holding unit shown in FIG. 2*a*.
Figure 2A:
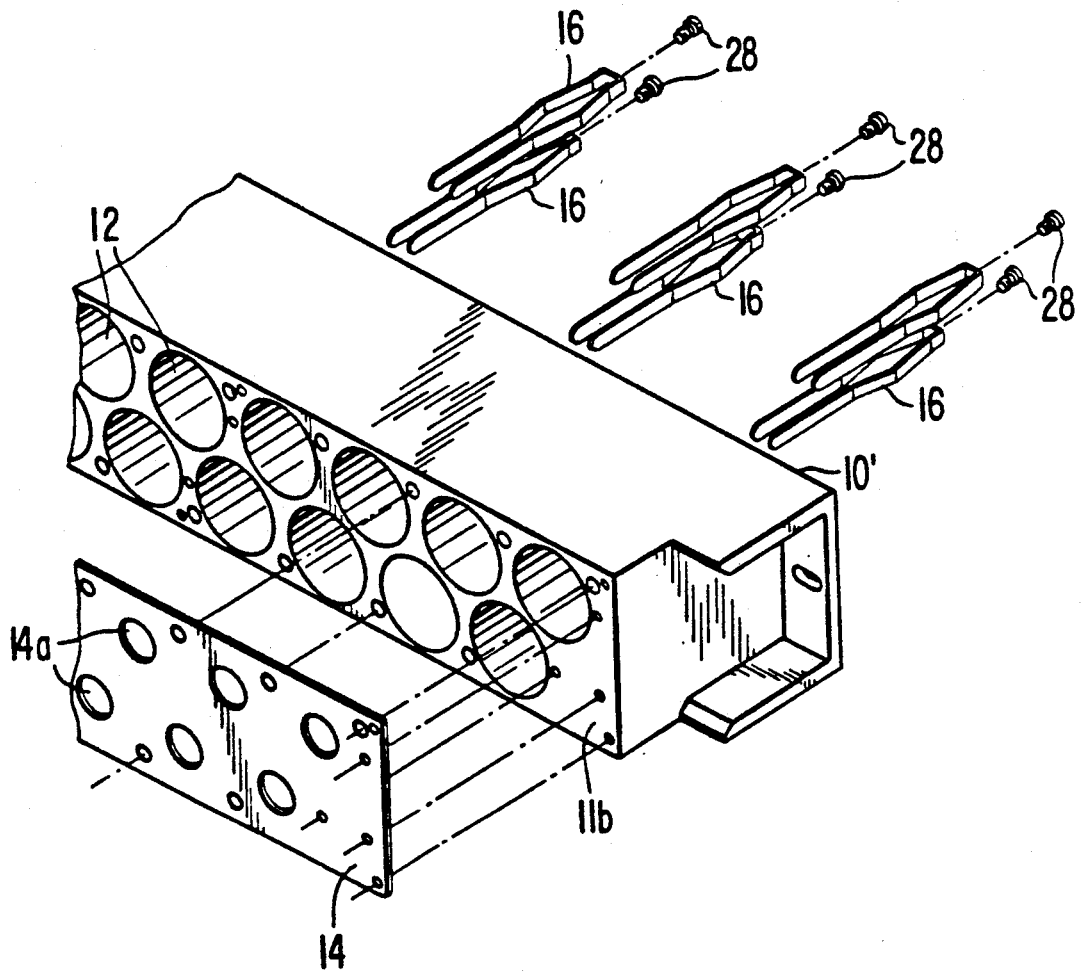

As shown in FIG. 2*a* of the drawings, which is a rear view of a modified holding unit according to the invention, holding unit 10' is a generally elongated member having a front surface 11*a* (see FIG. 2*b*), back surface 11*b* and two rows of cylindrical chambers 12 for receiving bottles 1. Each of the chambers 12 can extend through holding unit 10' between surfaces 11*a*, 11*b* and are separated from each other by walls formed between chambers 12. A bottom plate 14 with openings 14*a* can be attached via screws (not shown) to holding unit 10'. These openings 14*a* align with respective chambers providing a hole in the bottom of each chamber well.

Through openings 14*a*, an emitter and a detector can appropriately illuminate sensors and detect reflected luminescence so that each of the bottles 1 within holding unit 10' can be independently monitored through selected reading of outputs of each detector associated with the chambers. To ensure that bottles 1 inserted within chambers 12 are held squarely within the chambers so that accurate readings of the fluid within bottles 1 can be taken, the instant invention provides a support attachment 16 for every two chambers in such a holding unit.

Figure 3B:
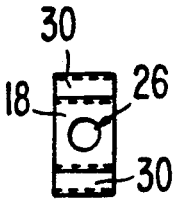
FIG. 3*b* is an end view of the support attachment shown in FIG. 3*a*.
Figure 3C:
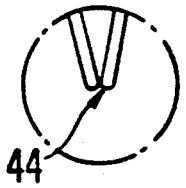
FIG. 3*c* is an enlarged view showing the details of the other end of the support attachment according to the invention.
Figure 3A:
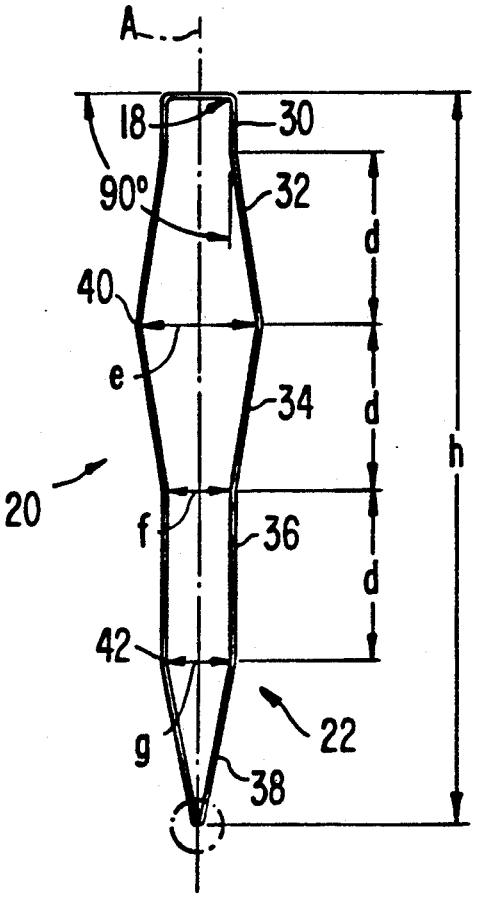
FIG. 3*a* is a plan view of the support attachment according to the instant invention.
Figure 3D:
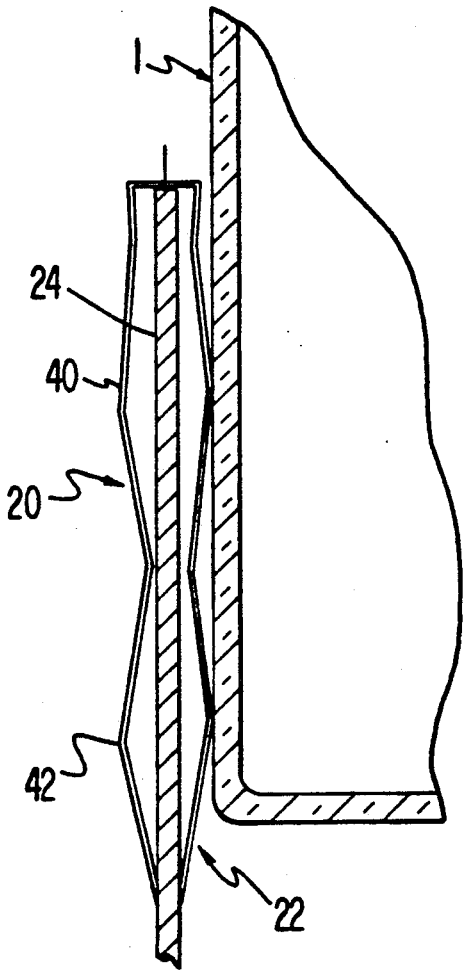
FIG. 3*d* is an enlarged view, partially in section, showing the insertion of a bottle against the support attachment.

Referring now to FIG. 3*a* of the drawings each support attachment 16 has a central axis A, a plate 18 and a pair of legs 20, 22. Leg 20, 22 are joined to plate 18 and extend from opposite ends of the plate in a symmetrical spaced relationship with respect to central axis A.

The positioning of support attachments 16 may be understood upon reference to FIG. 2*b* which shows the front surface 11*a* of holding unit 10' Legs 20, 22 are inserted into chambers 12 on opposite sides of wall members 24 and plate 18 is fitted onto wall members 24. Plate 18 can include an aperture 26 (see FIG. 3*b*) which aligns with the black dots (representing a threaded bore) of wall members 24 when plate 18 is fitted onto holding unit 10'. A fastener or screw 28 can be threaded into the bores represented by the black dots to fasten support attachment 16 to holding unit 10'.

Each leg of support attachment 16 has first and second ends and comprises a plurality of leg sections (30–38) between the first and second ends. The plurality of leg sections are arranged and constructed so that the second ends of each leg 20, 22 are normally biased toward one another and so that when a leg is inserted into a chamber it provides a fairly constant resistance against a bottle inserted within the chamber. The plurality of leg sections (30–38) are connected to one another at varying angles to create the bias between the second ends of each leg 20, 22 and so that at at least two points 40, 42 each of the legs extends radially inwardly toward the center of a chamber when plate 18 is fitted onto a wall member 24 of holding unit 10'.

A first leg section 30 extends substantially perpendicular to plate 18 and parallel to central axis A. A second leg section 3 extends from first leg section 30 at an angle away from central axis A. The third leg section 34 extends inwardly toward central axis A. The fourth leg section 36 extends from third leg section 34 substantially parallel to central axis A and a final fifth leg section 38 extends from the fourth leg section at an angle toward central axis A.

At point 40 where leg section 32 connects with leg section 34, the first pressure point which extends radially inward is formed. The second point which radially extends inwardly toward the center of a chamber 12 is formed where the fourth section 36 connects with the fifth section 38 at point 42. When the support attachment is attached onto wall member 24, points 40 and 42 extend approximately the same distance from the wall, thus forming two support points providing two pressure points for stabilizing the bottles within a chamber. The pressure points apply uniform force against the bottles and hold them squarely within the chamber, as shown in 3*d*.

When a bottle 1 is inserted within a chamber 12 to which support attachment 16 is attached, the pressure points 40, 42 ensure that the bottle has a sufficient friction fit with the far wall of the chamber 12 thus keeping the bottle still during movement of a holding unit.

Generally, the varying angles connecting leg sections are empirically determined to give a fairly constant resistance to the bottle. The height h of a support attachment is equal to the depth of the chamber to which it is attached minus approximately $\frac{1}{4}$-$\frac{3}{8}$ of an inch. The first section 30 of each leg 20, 22 extends from opposite ends of plate 18 at substantially right angles so that plate 18 and first sections 30 rest against the wall members of a holding unit to provide a sufficient fit. For ease of manufacturing the support attachment, each of leg sections 32-38 are substantially the same length d.

The support attachment can be made from any resilient material which is hard, wear resistant, anticorrosive and retains its spring characteristics. The legs can be constructed from a thin, flat, resilient material. Thin, in this application, is defined as between about 0.017 to 0.019 inches thick, preferably about 0.018 inches thick.

In a preferred support attachment designed for use with a Bac T Alert bottle holding unit, the attachment is of unitary construction made from a strip of specialty steel, 301 stainless steel full hard which is about 0.018 inches thick. It is critical that this stainless steel alloy is full hard so that it is hard, yet resilient enough to have the appropriate spring characteristics to receive a wider variety of manufactured bottles. The specialty steel is rolled so that the edges are smooth and thus minimizes the possibility of the attachment abrasing or gauging labels.

The preferred dimensions of such a support attachment includes a height h of about 3.25 inches, leg sections d of about 0.75 inches and between legs 20, 22, a distance e of about 0.500 inches, a distance f of about 0.280 inches and a distance g of about 0.300 inches.

Further, as shown in FIG. 3*c*, the second ends 44 of each leg means are rounded in an independent operation. These rounded edges ensure that the bottom of the attachment will not stick to either the chamber or bottle. As a result a smaller force is necessary to insert the bottles within the chambers.

After the support attachments are inserted into two adjacent chambers and fitted securely onto a wall member, bottles can be easily inserted and removed from the chamber. The legs are constructed or shaped that when a bottle is first inserted into a chamber, the entire insertion pressure force is on the first point 40 which is depressed without putting any stress on the second point 42. Thus, the support attachment according to the invention provides for ease of insertion and manufacturing variabilities.

It will be understood that the above description of the present invention is susceptible to various modifications, changes and adaptations, and the same are intended to be comprehended within the meaning and range of equivalents of the appended claims.

We claim:

1. A support attachment for use with a holding unit having at least two adjacent cavities with longitudinal axes for holding bottles, said support attachment having a central axis and comprising:

a plate adapted to be fitted to the holding unit; and a pair of elongated leg means in symmetrical spaced relationship with respect to said central axis for supporting bottles held in two adjacent cavities in the holding unit, each leg means extending, in the same direction, from opposite ends of the plate and having first and second ends, said first ends joined at substantially right angles to the plate and said second ends normally biased toward one another so that when the plate is fitted onto the holding unit, one of said leg means extends longitudinally into one of the adjacent cavities while the other said leg means extends into another adjacent cavity; each said leg means having a plurality of leg sections connected to one another at varying angles between said first and second ends, said leg sections being constructed and arranged so as to create the bias between the second ends of each leg means and to form at least two pressure points on each of said leg means which extend radially inwardly toward the center of a respective adjacent cavity when the plate is fitted onto the holding unit, said at least two pressure points contacting and applying a force against a bottle inserted in the respective adjacent cavity thereby holding the bottle within the cavity.

2. The support attachment as defined in claim 1, wherein the plate comprises means for fastening the support attachment to said holding unit.

3. The support attachment as defined in claim 1, wherein said leg means are constructed from a thin, flat resilient material.

4. The support attachment as defined in claim 3 wherein said material is metal.

5. The support attachment as defined in claim 1, wherein said at least two points comprises first and second pressure points and said plurality of leg sections includes a first leg section, corresponding to said first end, substantially perpendicular to the plate and parallel to the central axis; a second leg section extending from said first leg section at an angle away from said central axis; a third leg section extending from said second leg section at an angle toward said central axis, said second and third leg sections being connected at the first pressure point; a fourth leg section extending from said third leg section substantially parallel to the central axis; and a fifth leg section extending from the fourth leg section at an angle toward the central axis and ending at the second end so that the fifth sections of each leg means normally are biased toward one another, said fourth and fifth leg sections being connected at the second pressure point.

6. The support attachment as defined in claim 1, wherein said fastening means is a fastener receiving opening which receives a fastener for attaching the plate to a block.

7. The support attachment as defined in claim 1, wherein said plate and leg means are of unitary construction.

* * * * *